US010482864B1

(12) United States Patent
Johnson

(10) Patent No.: US 10,482,864 B1
(45) Date of Patent: Nov. 19, 2019

(54) PORTABLE ACOUSTICAL BLOCKING SYSTEM

(71) Applicant: L.J. Avalon, LLC., Tampa, FL (US)

(72) Inventor: Lahnie Johnson, Tampa, FL (US)

(73) Assignee: L.J. AVALON LLC, Tampa, FL (US)

( * ) Notice: Subject to any disclaimer, the term of this patent is extended or adjusted under 35 U.S.C. 154(b) by 0 days.

(21) Appl. No.: 15/338,240

(22) Filed: Oct. 28, 2016

Related U.S. Application Data

(60) Provisional application No. 62/248,894, filed on Oct. 30, 2015.

(51) Int. Cl.
*G10K 11/162* (2006.01)
*E04H 17/16* (2006.01)

(52) U.S. Cl.
CPC ..... *G10K 11/162* (2013.01); *E04H 17/16* (2013.01)

(58) Field of Classification Search
CPC ..... G10K 11/162
USPC ..... 181/30, 287
See application file for complete search history.

(56) References Cited

U.S. PATENT DOCUMENTS 4,193,474 A * 3/1980 Okubo ..... C04B 14/30 181/287
5,123,874 A * 6/1992 White, III ..... E04B 1/34321 181/290
7,918,312 B2 * 4/2011 Carlson ..... E04B 1/8236 181/287
8,136,626 B1 * 3/2012 Aliev ..... F24F 13/24 181/198
8,701,825 B2 * 4/2014 Yamamoto ..... E04B 1/8409 181/284
8,978,816 B2 * 3/2015 Slotznick ..... E04B 1/99 181/30
2009/0178882 A1 * 7/2009 Johnson ..... E04B 1/86 181/286
2014/0096301 A1 * 4/2014 Waller ..... A41D 7/00 2/67
2015/0224738 A1 * 8/2015 Gallagher ..... B32B 5/06 442/1

* cited by examiner

*Primary Examiner* — Forrest M Phillips

(74) *Attorney, Agent, or Firm* — Frijouf, Rust & Pyle P.A.

(57) ABSTRACT

A portable acoustical blocking system is disclosed for use with a support comprising a sheet of acoustical blocking material bound by material edge. A reinforcing tape is affixed to the sheet of acoustical blocking material adjacent to the material edge. A plurality of hangers are secured to the sheet of acoustical blocking material and extending through the reinforcing tape and the sheet of acoustical blocking material for hanging the sheet of acoustical blocking material from the support for inhibiting the flow of acoustic energy between the first and second sides of the acoustical blocking material.

11 Claims, 5 Drawing Sheets

*-14dB @ 40-50Hz = >60% noise reduction to the human ear

*-8.5dB @ 60Hz = aprox 45% noise reduction to the human ear

SAA = 0.07
NRC = 0.05

PORTABLE ACOUSTICAL BLOCKING SYSTEM

BACKGROUND OF THE INVENTION

Field of the Invention

This invention relates to sound control and more particularly to an improved flexible acoustical blocking material suitable for outdoor.

Background of the Invention

The prior art has known various types of devices and methods for reducing the level of sound within an environment. The various types of devices and methods of the prior art for reducing the level of sound within an environment included a diverse and variety of apparatuses and methods adapted for many as specific applications and uses.

One particular type of device for reducing the level of sound within an environment comprises the use of sound reducing panels and/or sound absorbing devices. Various types of sound reducing panels and sound absorbing devices have been incorporated by the prior art to reduce the level of sound and/or to selectively reduce or inhibit reflection of sound from reflective surfaces within an environment.

In some instances, the apparatuses and methods for reducing the level of sound within an environment selectively reduced the level of sound within an environment. Many of the apparatuses and methods for reducing the level of sound within an environment were specifically designed for providing enhancements for improving the acoustics within the environment. Sound reducing panels and sound absorbing devices have been employed in very large rooms such as auditoriums as well as smaller rooms such as recording studios, home theaters and the like.

Other apparatuses and methods for reducing the level of sound within an environment of the prior art reduce the overall level of acoustic noise and/or sound and/or noise within the environment. In many cases, sound absorbing apparatuses and methods were used to reduce the sound of operating machinery as well as being used for reducing the transmission of sound and/or noise between the adjacent walls of a building.

The following U.S. Patents are representative of the attempts of the prior art to provide apparatuses and devices for reducing sound within an environment.

U.S. Pat. No. 2,495,636 to O. R. Hoeltzel et al. discloses a unit comprising a layer of loosely matted mass of fibrous material. A substantially impervious preformed and film of thermoplastic synthetic resin material is integralized with the fibers in one face of the loosely matted material. A fabric covering on the other face of the loosely matted layer is enfolded and is secured about the edges of the mass and the film. The mass, film and fabric are in the form of the sound proof flexible panel adapted to cover and soundproof a section of a wall.

U.S. Pat. No. 2,497,912 to W. M. Rees discloses an acoustic construction for the walls and ceilings of an enclosure comprising a sound absorbing layer overlying the wall and formed by a plurality of rectangles or tiles of fibrous material arranged in a plane. The edge of each of the tiles is contiguous to and slightly spaced from the edges of adjoining tiles. A renewable facing for the sound absorbing layer includes a plurality of thin sheets of porous material individual to the tiles. Each of the sheets having tabs at its edges integral with the sheets and resiliently held in place between adjacent edges of the tiles to hold the sheets in place over the face of the tiles.

U.S. Pat. No. 2,553,363 to C. C. Droeger discloses a non-combustible wall or ceiling of a plurality of parallel, latterly spaced, non-combustible primary furrings anchored thereon. Sound absorbent pads are arranged between adjacent pairs of furrings. A plurality of spaced, non-combustible secondary furrings extend extended transversely across the primary furrings and are secured thereto. Each of the secondary furrings comprise a portion lying in a plane parallel with the wall or ceiling and bridging between primary furrings and are provided with a multiplicity of perforations adapted to threadably receive threaded shanks of screws. A multi-perforate finish sheaths overlies the aforesaid parts.

U.S. Pat. No. 2,694,025 to G. Slayter et al. discloses a structural board comprising a core of glass fibers bounded into a porous self-sufficient layer. A layer of substantially inorganic cementitious material is integrated with at least one of the faces of the core. The cementitious layer is formed of a composition consisting essentially of an amide-aldehyde resin selected from the group consisting of urea formaldehyde and melamine formaldehyde and gypsum cement.

U.S. Pat. No. 2,923,372 to M. Maccaferri discloses an all plastic acoustic tile formed of a molded plastic material comprising a plate-like body having a rearwardly extending edge flange thereabout integral therewith. The body is formed to provide the front side thereof as a flat, planar face and having a multiplicity of apertures therethrough from the front face to and opening through the rear side all the body. Sound wave dampening tubes are molded integrally with the body projecting rearwardly from the rear side thereof. Each of the dampening tubes has a passage therethrough opening at the rear end thereof. Each of the dampening tubes is located on the rear side of the body in position with a body aperture opening into and forming the inlet to the passage of the dampening tube. The body has the rear side thereof formed with an annular recess therein about each of the dampening tubes providing a reduced thickness base portion of the body with which the tube is integrally joined.

U.S. Pat. No. 3,136,397 to O. C. Eckel discloses an assembly with two angular adjoining walls and a ceiling. The assembly comprises a plurality of panels with a first of the panels extending along the ceiling from the first wall. A second of the panels extends along the first wall below the ceiling panel. A Z-shaped retainer embodying one angular portion is attached to the first wall. Another angular portion extends laterally away from the wall indirectly below the first ceiling panel and above the second panel. And a third angular portion extends downwardly away from the ceiling panel. The ceiling first panel rests on the other angular portion of the retainer.

U.S. Pat. No. 3,949,827 to Witherspoon discloses an acoustical panel assembly having improved structural, decorative and acoustical properties. The panel assembly includes a perimeter frame. A thin septum member is supported in the center of the frame. A fibrous glass layer is positioned adjacent each side of the septum member. A molded, semi-rigid, fibrous glass diffuser member is positioned adjacent each of the fibrous glass layers. The assembly includes means for joining adjacent panel assemblies and, in one embodiment, an outer decorative fabric layer is positioned adjacent each of the outer surfaces of the diffuser members.

U.S. Pat. No. 3,967,693 to Okawa discloses a means and method for diminishing energy of sound. A corrugated cover having holes therethrough is mounted on a wall by ribs and an edge plate. The wall and edge plate together with the ribs and corrugated cover form a plurality of chambers, each cooperating with a plurality of the holes for diminishing the energy of impinging sound waves.

U.S. Pat. No. 4,113,053 to Matsumoto et al. discloses a sound absorbing body which can effectively be utilized as an exterior sound absorbing wall or an interior wall of a house. The sound absorbing body comprises a number of sound absorbing cavities inclined at an angle alpha which is smaller than 80 degrees with respect to a transverse horizontal sectional plane of the body. The sound absorbing cavities being opened at the sound incident surface.

U.S. Pat. No. 4,160,491 to Matsumoto et al. discloses a perlite sound absorbing plate and a sound insulating wall constructed by arranging a number of the plates side by side and by assembling together into one integral body. The plate is composed of a mixture including 1,000 cubic centimeters by bulk volume of formed perlite particles each having a diameter of 0.1 to 7.0 millimeters 100 to 140 grams of cement, liquid rubber latex containing 5 to 20 grams of solid ingredients and a suitable amount of water and produced by press molding with a compression ratio of 1.10 to 1.30. The wall is constructed by assembling a number of the plates each provided with a side groove with the aid of supporting columns and reinforcing plates, each having a ridge adapted to be engaged with the side groove of the plate.

U.S. Pat. No. 4,207,964 to Taguchi discloses a sound absorbing and diffusing unit provided for assembling an acoustic screen which can be placed or hung in front of a wall inside an acoustic room for improving a sound-effect therein. These units are detachably joined together with each other so that they may be easily separated and assembled again to form an acoustic screen having another shape or construction to adjust or modulate a sound-effect. A sound absorbing porous panel having a desired picture or pattern can be easily hung against a wall. The decorative panel can be reversely hung on the wall to provide another interior ornamentation. Accordingly, an acoustically correct room and a desired ornamentation on a wall inside the acoustic room can be easily obtained and changed without providing a rigid reverberating surface of the room.

U.S. Pat. No. 4,248,325 to Georgopoulos discloses an improved sound absorptive tackable space dividing wall panel or similar article in which a wire mesh screen is disposed within the sound absorptive material a distance from the tackable surface less than the length of the tack pin, thereby providing additional support for the tackable load without appreciably reducing the sound absorptive characteristics of the panel.

U.S. Pat. No. 4,306,631 to Reusser discloses a noise barrier or other type wall or building assembly including a plurality of spans each extending between spaced apart posts and having top and bottom girts affixed to the posts and in turn supporting a plurality or series of vertically disposed panels. Unique mating interlock elements integrally formed along both lateral edges of the wall or building exterior panels allow the sequential interconnection of all panels in a series by means of a rotating displacement of the individual panels to yield multilateral interlocking of the panels. The panel faces are configured to provide shadow texture, while masking of the posts and top girts in a free-standing type wall is obtained by a split cover assembly and split cap trim, respectively.

U.S. Pat. No. 4,402,384 to Smith et al. discloses a sound barrier system particularly suited for out-of-doors, ground-mounted installations, such as for a highway noise barrier comprising a vertical wall composed of successive individual wall sections arranged with immediately adjacent wall sections disposed at an intersecting angle to each other. Immediately adjacent wall sections are rigidly joined together in abutment along a common vertical joint. An earth anchor is anchored into the ground at each vertical joint. Each joint is secured to the corresponding earth anchor so that downwardly directed hold-down forces are applied by the earth anchors to the wall at the bottom portions of the joints.

U.S. Pat. No. 4,605,090 to Melfi discloses a post and panel type noise barrier fence formed of a plurality of concrete vertical posts or columns which have grooves to hold flat concrete panels between successive ones of the columns. The panels can have a stepped lower edge to accommodate elevational changes in the terrain. Also, certain of the columns have oppositely disposed recesses angled from each other so as to accommodate directional changes at the columns in the direction of the barrier fence.

U.S. Pat. No. 4,607,466 to Allred discloses an acoustic panel having a porous layer and a generally rigid layer affixed to each other. The generally rigid layer includes at least one passageway opening on one side of the rigid layer and extending through the rigid layer to the porous layer. The porous layer is a fibrous material. The rigid layer is a concrete-type material, such as vermiculite-cement plaster. This acoustic panel further comprises a generally rigid planar surface positioned adjacent to the porous layer. This generally rigid planar surface can comprise an insulating layer affixed to the other side of the porous layer and a structural layer fastened to the insulating layer. The insulating layer is a polyurethane foam board. The structural layer is a particle board.

U.S. Pat. No. 4,805,734 to Mast discloses an acoustic wall for streets and parks and for garden-like designs consisting of several substantially U-shaped frame members arranged at a distance from one another, which frame members are connected among one another and have mats applied on their front and side surfaces. In order to substantially reduce the manufacture on location, the duration of setting up and the greening time on location, the acoustic wall consists of individual elements of which each has several U-shaped frame members which are secured at the ends of their long legs on a base. The base forms a rigid frame with fastening means for a lift for the lifting and transporting of the acoustic wall. One or several narrow-mesh mats are secured on the base, which mats prevent a falling out of material filled into the acoustic wall during transport.

U.S. Pat. No. 4,834,213 to Yamamoto et al. discloses a noise silencer for highways adapted to be stuffed in a joint gap formed in a highway. It has a rectangular casing and padding enclosed in the casing. The casing is provided with a vent hole adapted to be closed by a plug. Before mounting the noise silencer, air is firstly sucked out from the silencer through the vent hole to flatten the padding and the vent hole is plugged. After the silencer has been mounted, the vent hole is open to inflate the padding so that the silencer will be pressed against the opposite walls of the joint gap.

U.S. Pat. No. 5,217,771 to Schmanski et al. discloses a device for preventing the transmission of sound, the device being fabricated of polymer composition and comprising a hollow core member formed of fiber-reinforced thermosetting resin, and at least an outer member formed of unreinforced thermoplastic resin which is friction fit to the core member. The core member and outer members are preferably formed by pultrusion and extrusion, respectively. Adjacently disposed devices are connected together to form a fence-like barrier through which few or no sound waves are allowed to pass. This system is advantageously used to prevent sound waves emanating from a large transportation structure such as a highway, railroad track, or airport.

U.S. Pat. No. 5,272,284 to Schmanski discloses a sound wall for placement along a roadside for reducing the transmission of sound from a traffic area wherein the sound wall comprises a plurality of stiff, resilient containment members respectfully configured with the channel configuration and having an enclosed channel volume and continuous open side. Each channel volume is filled with a composite composition of rubber chips and binder compressed within the channel and substantially filling the channel volume. These containment members are stacked in nesting relationship to form a wall structure, with the open side being oriented toward the traffic area.

In my prior invention set forth in U.S. Pat. No. 7,063,184, I disclosed an apparatus and method of making an improved sound reducing panel suitable for use in an outdoor or a hazardous environment. The improved sound reducing panel comprises a water resistant sound absorbing member with a porous covering sheet overlaying a face surface of the sound absorbing member. A support frame is disposed about an outer perimeter of the sound absorbing member. An attachment secures the improved sound reducing panel to the support frame. In one embodiment, a sound blocking member is located adjacent to the sound absorbing member.

In another prior invention set forth in U.S. Pat. No. 7,503,428, 1 disclosed an apparatus and method for an improved acoustic panel comprising a sound absorbing member defined by a first and second face surface and a plurality of peripheral edges. A sound blocking member is defined by a first and second face surface and a plurality of peripheral edge. The first face surface of the sound blocking member is secured relative to the second face surface of the sound absorbing member for blocking the transmission of sound therethrough. In another embodiment, the first face surface of the sound blocking member is spaced relative to the second face surface of the sound absorbing member for decoupling the sound blocking member from the sound absorbing member.

In still another prior invention set forth in U.S. Pat. No. 7,513,082, I disclosed a system for reducing the transmission of acoustical energy between a first and second wall surface of a wall comprising a first and a second beam for supporting a sound panel. Each of the first and second beams comprises first and second flanges interconnected by an inner connector with a fold defined in the inner connector for reducing the transmission of acoustical energy between the first and second flange. The fold cooperates with one of the flanges for defining a pocket for receiving an edge of a sound panel. The first and second flange support the first and second wall surface of the wall with the sound panel.

In still further prior invention set forth in U.S. Pat. No. 8,739,924, 1 disclosed an apparatus and method is disclosed for an improved acoustic panel comprising a sound absorbing member defined by a first and second face surface and a plurality of peripheral edges. A sound blocking member is defined by a first and second face surface and a plurality of peripheral edge. The first face surface of the sound blocking member is secured relative to the second face surface of the sound absorbing member for blocking the transmission of sound therethrough. In another embodiment, the first face surface of the sound blocking member is spaced relative to the second face surface of the sound absorbing member for decoupling the sound blocking member from the sound absorbing member.

It is an object of the present invention to continue to improve upon my prior inventions by providing a portable acoustical blocking system.

Another object of this invention is to provide a portable acoustical blocking system that is suitable for outdoor use.

Another object of this invention is to provide a portable acoustical blocking system that may be rolled for easy transportation and storage.

Another object of this invention is to provide a portable acoustical blocking system that may be readily fastened to existing supports such a fences and the like.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to a portable acoustical blocking system for use with a support. The portable acoustical blocking system comprises a sheet of acoustical blocking material having a first and a second side and bound by material edge. A reinforcing tape is affixed to the first side of the sheet of acoustical blocking material adjacent to the material edge. A plurality of hangers are secured to the sheet of acoustical blocking material and extending through the reinforcing tape and the sheet of acoustical blocking material for hanging the sheet of acoustical blocking material from the support for inhibiting the flow of acoustic energy between the first and second sides of the acoustical blocking material. The portable acoustical blocking system may be secured to a variety of supports such as horizontal poles, fences lentils and the like.

Preferably, the material edge of the sheet of acoustical blocking material includes a first through fourth edge defining a perimeter of the sheet of acoustical blocking material. The sheet of acoustical blocking material is flexible for enabling the sheet of acoustical blocking material to be rolled for transportation and storage.

In one example, the sheet of acoustical blocking material comprises a sheet of flexible barium free formulation mineral filled to have a weight greater than one pound per square foot. Preferably, the sheet of acoustical blocking material has a thickness of approximately one-eighth of an inch and comprises a barium free formulation mineral filled to have a density of greater than one pound per square foot.

In a more specific example of the invention, the reinforcing tape is heat welded to the first side of the sheet of acoustical blocking material. Preferably, the reinforcing tape comprises a woven polyester material.

In another specific example, each of the plurality of hangers comprises a grommet defining a grommet aperture. A plurality of flexible ties secure the plurality of hangers to the support.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
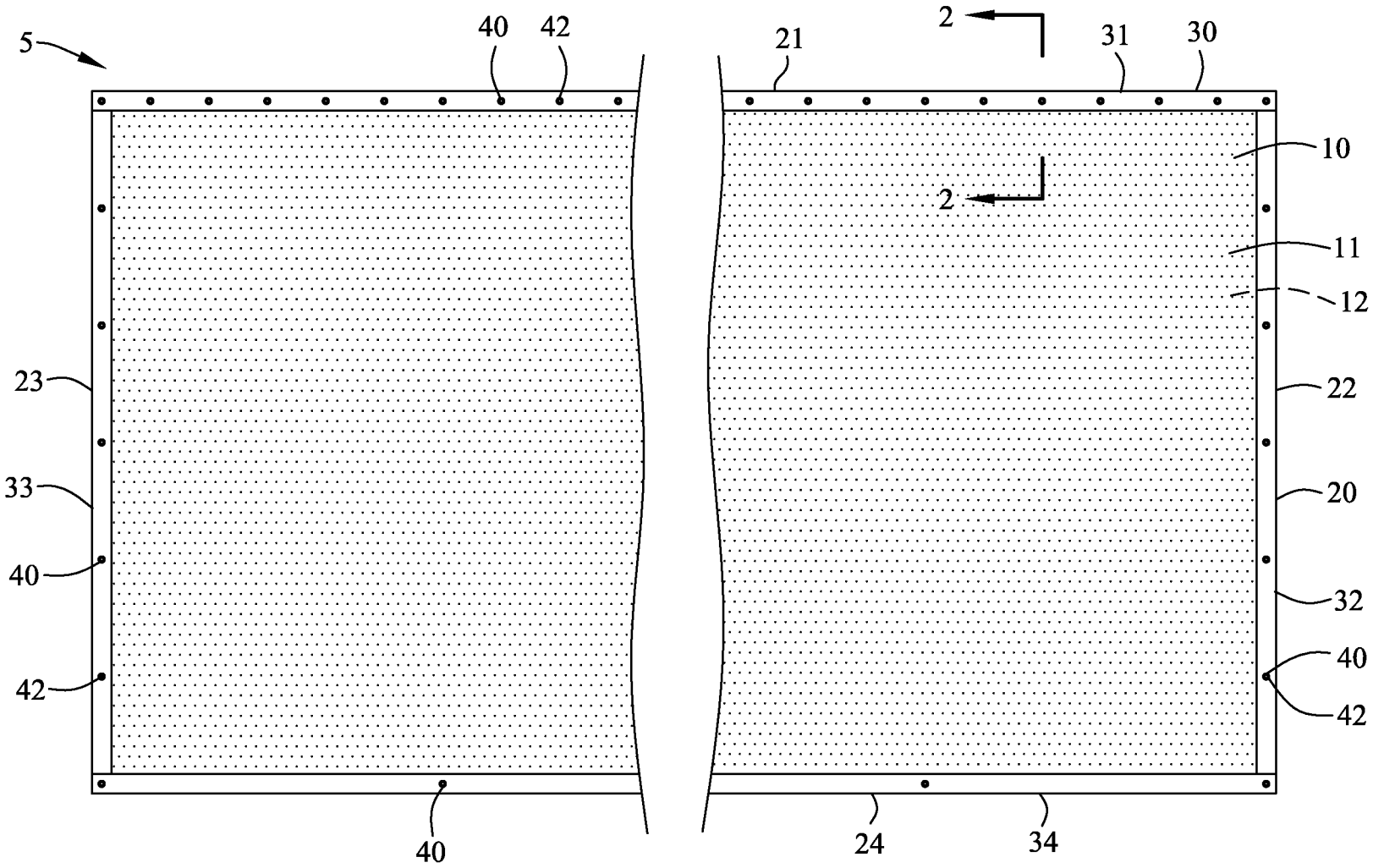
FIG. 1 is a front view of the portable acoustical blocking system of the present invention.
Figure 2:
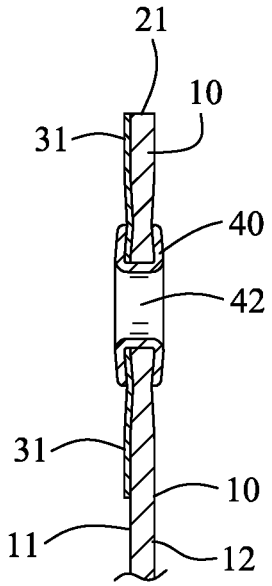
FIG. 2 is an enlarged sectional view along line 2-2 in FIG. 1.
Figure 3:
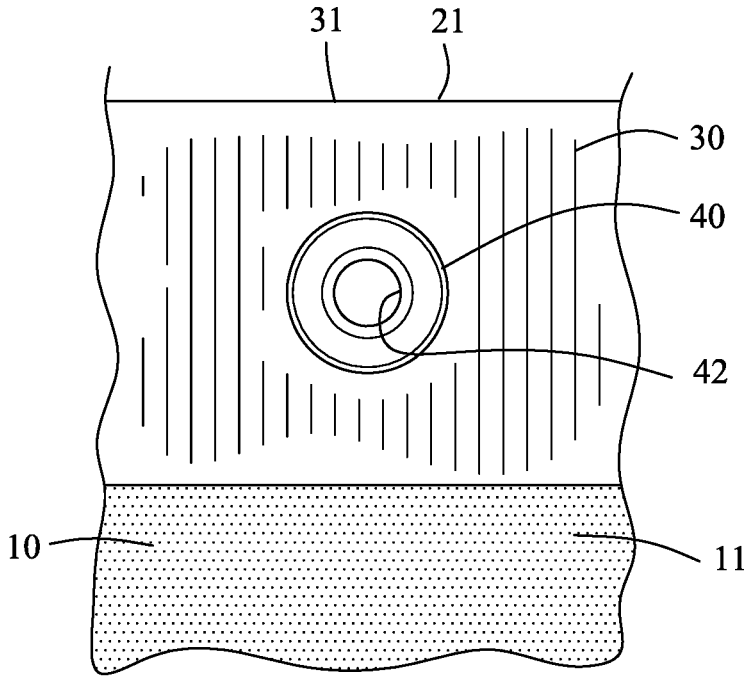
FIG. 3 is a magnified view along line 3-3 in FIG. 2.

FIGS. 1-3 are various views of the portable acoustical blocking system 5 of the present invention. The portable acoustical blocking system 5 comprises sheet of acoustical blocking material 10 having a first side surface 11 and a second side surface 12. The sheet of acoustical blocking material 10 is bound by a material edge 20. In this example, the sheet of acoustical blocking material 10 is bound by a top material edge 21, side material edges 22 and 23 and a bottom material edge 24. The material edges 21-24 define a perimeter of the sheet of acoustical blocking material 10. Although the parameter defined by the material edges 21-24 are shown as a rectangular configuration, it should be understood by those skilled in the art and that the sheet of acoustical blocking material 10 may take various configurations.

FIG. 2 is an enlarged sectional view along line 2-2 in FIG. 1. In this example, the sheet of acoustical blocking material 10 has a thickness of approximately one-eighth of an inch. The acoustical blocking material 10 comprise a heavy mineral filled, barium free visco elastic acoustical material having a density of greater than one pound per square foot. The sheet of acoustical blocking material 10 is flexible for enabling the sheet of acoustical blocking material 10 to be rolled for transportation and/storage.

Important aspect of the present invention is the addition of a reinforcing tape 30 affixed to the first side of the sheet of acoustical blocking material 10 adjacent to the material edge 20. In this example, reinforcing tapes 31-34 are affixed adjacent to the material edges 21-24 respectively. The reinforcing tape 30 is heat welded to the first side 11 of the sheet of acoustical blocking material 10. In the heat welding process, both the first side 11 of the sheet of acoustical blocking material 10 and the reinforcing tape 30 are simultaneously heated to an appropriated temperature. After the acoustical blocking material 10 and the reinforcing tape 30 are simultaneously are heated to the appropriated temperature, the reinforcing tape 30 is pressed upon the first side 11 of the sheet of acoustical blocking material 10. In one example, the reinforcing tape comprises a woven polyester material but it should be understood that various other materials may be used as a reinforcing tape 30.

Referring back to FIG. 1, a plurality of hangers 40 are secured to the sheet of acoustical blocking material 10. The plurality of hangers 40 enable the sheet of acoustical blocking material to be suspended from a support for inhibiting the flow of acoustic energy between the first side surface 11 and second side surface 12 of the acoustical blocking material 10.

FIG. 3 is a magnified view along line 3-3 in FIG. 2 further illustrating one of the plurality of hangers 40. Each of the plurality of hangers 40 extends through the reinforcing tape 30 and the sheet of acoustical blocking material 10. The reinforcing tape 30 provides structural strength to the plurality of hangers 40 for suspending the sheet of acoustical blocking material from a support.

In this example, the plurality of hangers 40 are shown as grommets having grommet apertures 42. Although the plurality of hangers 40 are shown as grommets having grommet apertures 42, it should be understood by those skilled in the art and that the plurality of hangers 40 may take various configurations.

Figure 4:
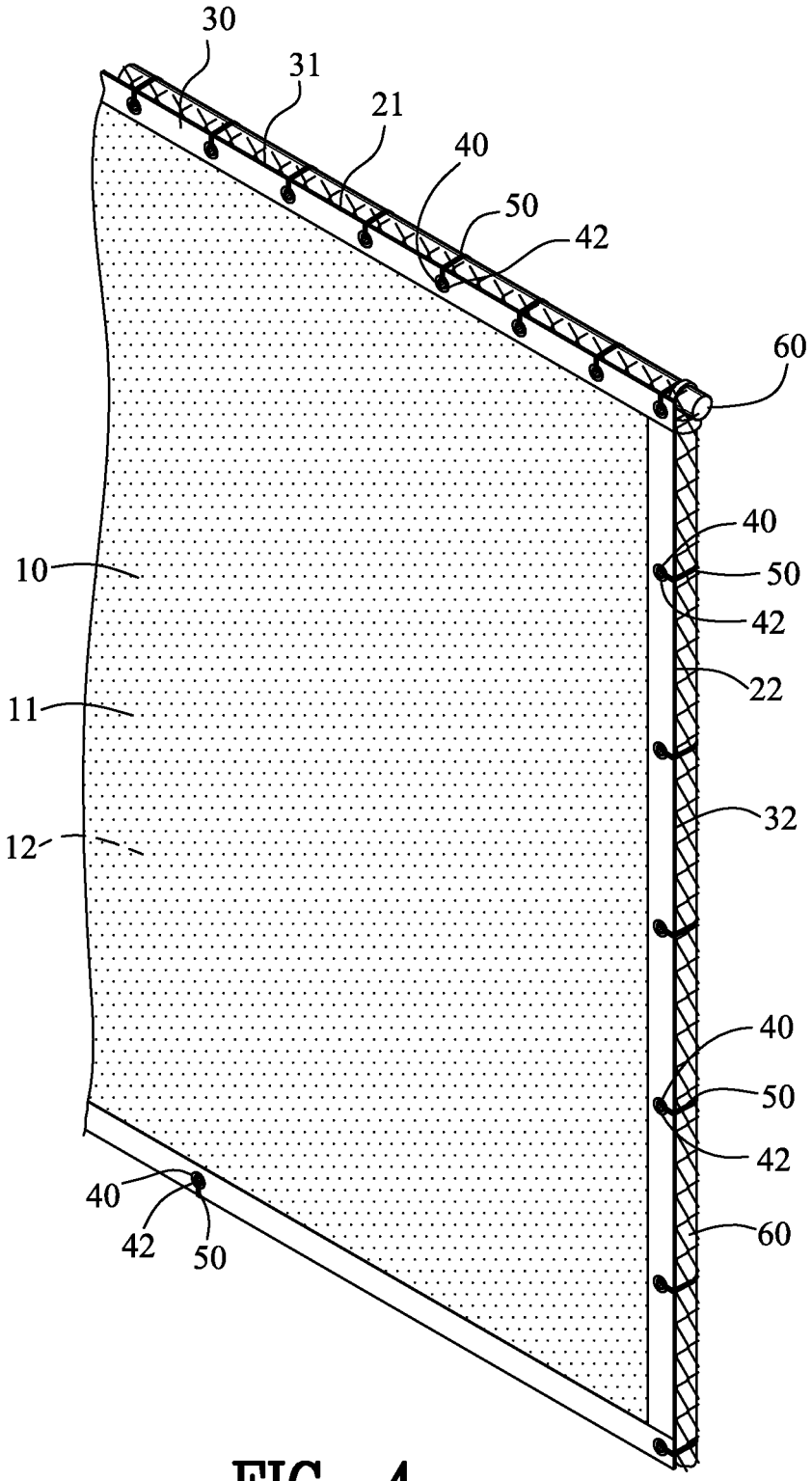
FIG. 4 is an isometric view of the portable acoustical blocking system 10 of the present invention secured to a support shown as a fence.

FIG. 4 is an isometric view of the portable acoustical blocking system 10 of the present invention secured to a support shown 60 as a fence. It should be appreciated by those skilled in the art that virtually any support may be used to suspend the portable acoustical blocking system 10 including scaffolding, staggered wood shadow box privacy fences, handrails, horizontal supports and the like. The portable acoustical blocking system 10 finds particular use along rail and road transportation.

A plurality of flexible ties 50 secure the plurality of hangers 40 to the support 60 by extending through the grommet apertures 42 and encircling the support 60. In one example, the plurality of flexible ties 50 are metallic cable ties although various types of flexible ties may be used in the present invention.

Figure 5:
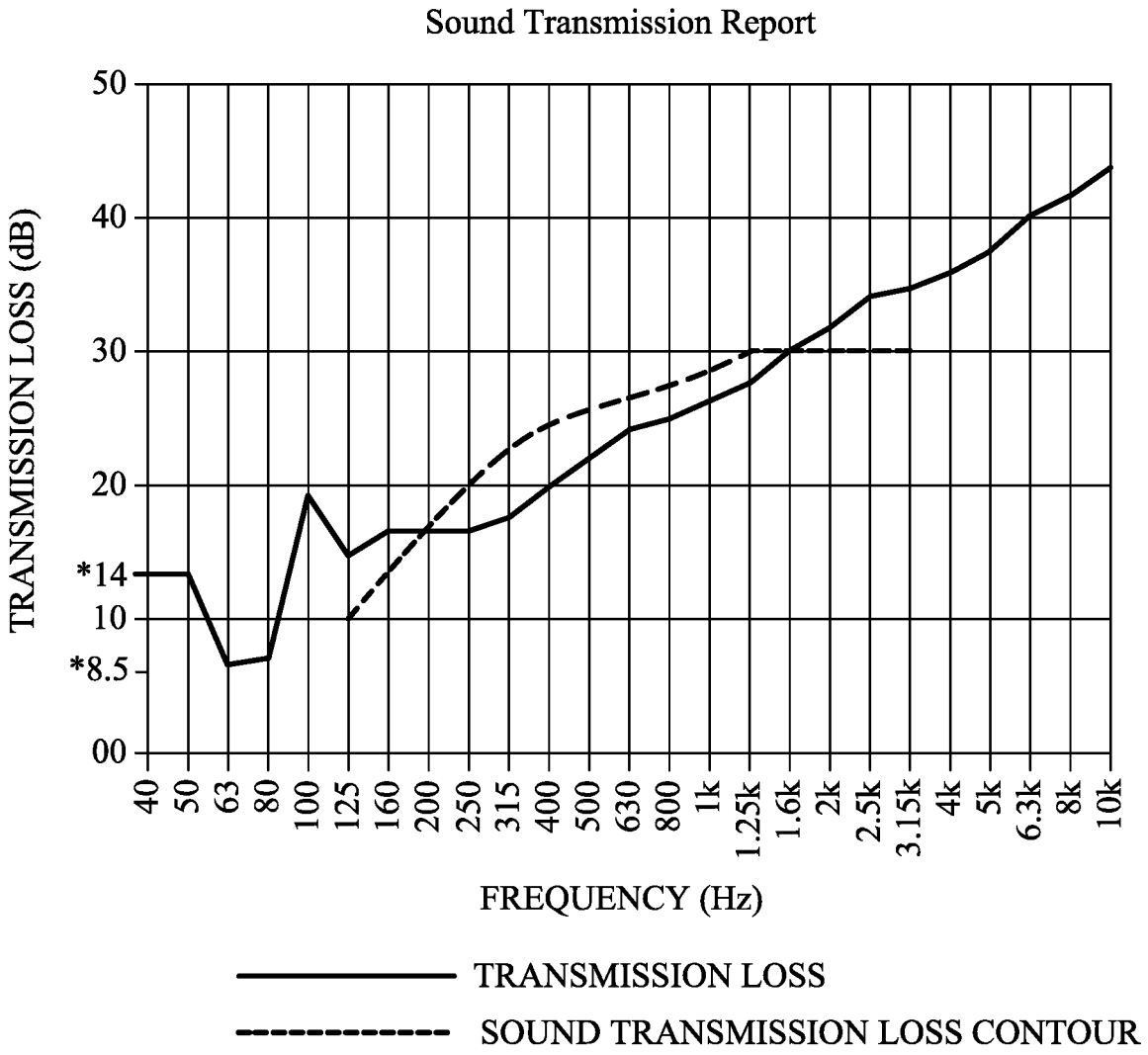
FIG. 5 is a graph of sound transmission loss as a function of frequency for the portable acoustical blocking system of the present invention.

FIG. 5 is a graph of sound transmission loss as a function of frequency for the portable acoustical blocking system 5 of the present invention. The portable acoustical blocking system 5 been tested in independent certified acoustical labs and the sound transmission coefficient (STC) of 28 represents a 85% reduction of sound to the human ear.

Figure 6:
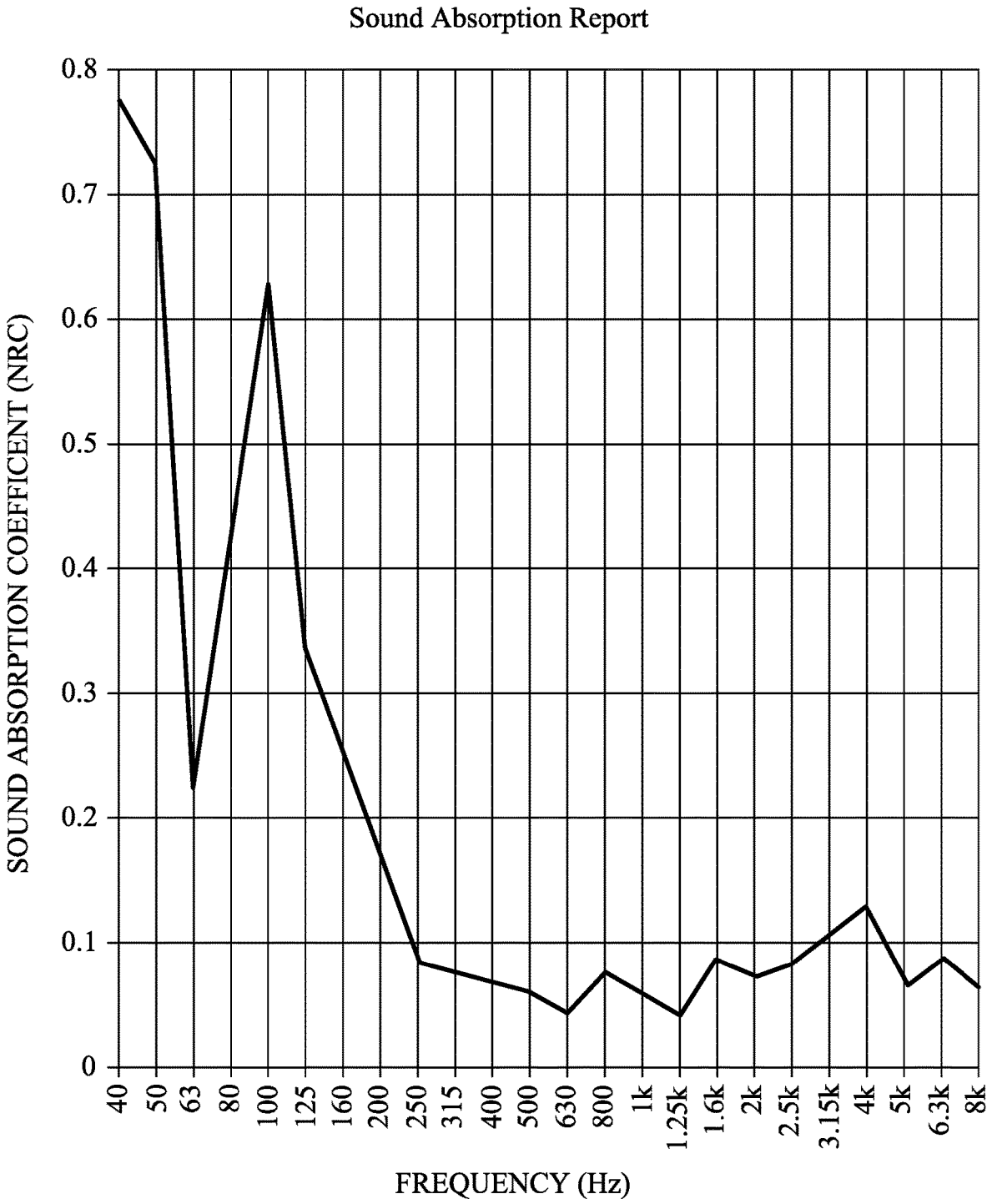
FIG. 6 is a graph of sound absorption as a function of frequency for the portable acoustical blocking system of the present invention.

FIG. 6 is a graph of sound absorption as a function of frequency for the portable acoustical blocking system 5 of the present invention. In frequencies of 50 Hz and below, the heavy limp acoustical blocking material 10 begins to vibrate from low frequency sound waves. The acoustical blocking material 10 transformis low frequency sound waves into mechanical movement and internal friction energy within the acoustical blocking material 10. Laboratory tests indicate that this transformation process reduces these low frequencies from penetrating the acoustical blocking material 10 by over 60 percent relative to the human ear. In addition the acoustical blocking material 10 becomes as an absorbent material in these frequencies with test results showing in an NRC (noise reduction coefficient) as high as 0.78 (1.00 being the max). The acoustical blocking material 10 has a 0.078 NRC (noise reduction coefficient) at the very low freq of 40 Hz and a NRC (noise reduction coefficient)od 0.063 at 100 Hz. The acoustical blocking material 10 not only reduces sound as a barrier, but also acts as an acoustical absorbent material at very low frequencies. Very low frequencies are not reflected as other sound barriers. In contrast to a ridged barrier, the acoustical blocking material 10 mass flexes at low frequencies transforming the acoustical energy into inaudible internal friction energy.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A portable acoustical blocking system for use with a support, comprising:

a sheet of acoustical blocking material having a first and a second side and bound by material edge;

said sheet of acoustical blocking material having a thickness of approximately one-eighth of an inch and a density of greater than one pound per square foot;

a flexible reinforcing tape permanently affixed to said first side of said sheet of acoustical blocking material adjacent to said material edge;

a plurality of hangers secured to said sheet of acoustical blocking material and extending through said reinforcing tape and said sheet of acoustical blocking material for hanging said sheet of acoustical blocking material from the support for inhibiting the flow of acoustic energy between said first and second sides of the acoustical blocking material; and said sheet of acoustical blocking material and said reinforcing tape being flexible for enabling the entire portable acoustical blocking system including said sheet of acoustical blocking material and reinforcing tape to be rolled as a single unit for transportation.

2. A portable acoustical blocking system as set forth in claim 1, wherein the support is a chain link fence.

3. A portable acoustical blocking system as set forth in claim 1, wherein said material edge of said sheet of acoustical blocking material includes a first through fourth edge defining a perimeter of said sheet of acoustical blocking material.

4. A portable acoustical blocking system as set forth in claim 1, wherein said sheet of acoustical blocking material comprises a sheet of flexible barium free formulation mineral filled to have a weight greater than one pound per square foot.

5. A portable acoustical blocking system as set forth in claim 1, wherein said sheet of acoustical blocking material comprising a barium free formulation mineral filled.

6. A portable acoustical blocking system as set forth in claim 1, wherein said reinforcing tape comprises a woven polyester material.

7. A portable acoustical blocking system as set forth in claim 1, wherein each of said plurality of hangers comprises a grommet defining a grommet aperture.

8. A portable acoustical blocking system as set forth in claim 1, including a plurality of flexible ties for securing said plurality of hangers to the support.

9. A portable acoustical blocking system for use with a support, comprising:

a sheet of acoustical blocking material having a first and a second side and bound by material edge;

said sheet of acoustical blocking material having a thickness of approximately one-eighth of an inch and a density of greater than one pound per square foot;

a reinforcing tape heat welded to said first side of said sheet of acoustical blocking material adjacent to said material edge;

said sheet of acoustical blocking material and said reinforcing tape being flexible for enabling the entire portable acoustical blocking system including said sheet of acoustical blocking material and reinforcing tape to be rolled for transportation; and a plurality of hangers secured to said sheet of acoustical blocking material and extending through said reinforcing tape and said sheet of acoustical blocking material for hanging said sheet of acoustical blocking material from the support for inhibiting the flow of acoustic energy between said first and second sides of the acoustical blocking material.

10. A portable acoustical blocking system as set forth in claim 9, wherein each of said plurality of hangers comprises a grommet defining a grommet aperture.

11. A portable acoustical blocking system as set forth in claim 9, wherein each of said reinforcing tape and said first side of the sheet of acoustical blocking material are simultaneously heated to an appropriated temperature and said reinforcing tape is pressed upon said first side of said sheet of acoustical blocking material.

* * * * *